US005215542A

United States Patent [19]

Pore

[11] Patent Number: 5,215,542

[45] Date of Patent: Jun. 1, 1993

[54] PROCESS FOR FLESHING SKINS

[75] Inventor: Jean Pore, Yerres, France

[73] Assignee: Societe Francaise Hoechst

[21] Appl. No.: 737,693

[22] Filed: Jul. 30, 1991

[30] Foreign Application Priority Data

Aug. 21, 1990 [FR] France ..... 90 10522

[51] Int. Cl.[5] ..... C14C 1/00

[52] U.S. Cl. ..... 8/94.15

[58] Field of Search ..... 8/94.15

[56] References Cited

U.S. PATENT DOCUMENTS 1,961,740 6/1934 Conquest ..... 8/94.15

FOREIGN PATENT DOCUMENTS 2656332 6/1991 France .

1406173 6/1988 U.S.S.R. .

1587110 4/1981 United Kingdom .

*Primary Examiner*—Prince Willis, Jr.

*Assistant Examiner*—Alan D. Diamond

*Attorney, Agent, or Firm*—Remy J. VanOphem

[57] ABSTRACT

Process for fleshing skin in which skins which are to be fleshed are treated using a silica sol containing preferably from 30 to 50% by weight of silica in a non-agglomerated particle state with an average diameter of 9 to 100 nm then they are subjected to standard fleshing.

5 Claims, No Drawings

PROCESS FOR FLESHING SKINS

BACKGROUND OF THE INVENTION

The present invention relates to a process for fleshing skins.

In the tanning or tawery industry, it is known that fleshing is a delicate and unpleasant operation. The complete elimination of flesh, notably from pickled sheep skins originating in the southern hemisphere, is often laborious and it generally causes, when it is incomplete, a retraction of the skin leading to a 2 to 5% reduction in the finished surface area. Moreover, badly fleshed skins are sometimes difficult to subsequently degrease. In order to obviate these inconveniences, the Applicant has discovered a new skin fleshing process characterized by the fact that the skins to be fleshed are treated with a silica sol then the standard fleshing operations are carried out on the skins treated in this way. The silica sol can be used, for example, at a rate of 0.2% to 3% by weight relative to the weight of skins in this state.

By silica sol is meant, a commercial silica sol containing, by weight, preferably from 30 to 50% silica in a non-agglomerated particle state, with an average diameter of 9 to 100 nanometers, advantageously from 9 to 50 nanometers. The silica sol is advantageously employed in aqueous solution.

SUMMARY OF THE INVENTION

The skins which can be treated by the process of the invention can be sheep, goat, pig, cattle, reptile or bird skins. These skins are generally the product of a soaking back process but they can, in certain cases, have been subjected to a preservation pickling notably for sheep and bird skins originating in the southern hemisphere.

DETAILED DESCRIPTION OF THE PREFERRED EMBODIMENT

The process according to the invention can be carried out on skins, at the end of soaking back, in a fulling machine, a paddle vat, or any other similar apparatus. The operation preferably takes place at ambient temperature, for 15 to 20 minutes, in water in the presence of silica sol containing notably from 30 to 50% silica in a non-agglomerated particle state with an average diameter of 9 to 100 nanometers, at the rate of 0.2 to 3% by weight relative to the weight of skins in this state. Then the skins are tumbled and they are subjected to a standard fleshing process. The process according to the invention allows rapid, easy and complete fleshing to be obtained, with the elimination of flesh in the form of a sheet, generally all in one piece, and it provides skins which do not retract due to tanning the flesh which leads to an increase in the finished surface area for skins which are not stripped to pelts.

When the process according to the invention is used on pickled skins, it is preferable to work in an aqueous medium containing 5 to 7% sodium chloride.

According to a variant, the process of the invention can also be applied to limed skins or pelts in identical conditions.

The following example illustrates the present invention without however limiting it.

EXAMPLE 100 kg of pickled sheep skins are treated in a fulling machine with 400 kg of water containing 6% sodium chloride and 2 kg of silica sol containing 30% silica in the form of non-agglomerated particles with an average diameter of 50 nm, for 20 minutes at ambient temperature, then the skins are tumbled and finally they are fleshed on a fleshing machine. In this way a rapid and easy fleshing is obtained and the flesh is collected in the form of a sheet generally all in one piece.

I claim:

1. Process for fleshing skins comprising the steps of treating said skins with a silica sol and then fleshing said skins.

2. Process for fleshing skins according to claim 1, wherein said silica sol is dispersed in an aqueous solution.

3. Process for fleshing skins according to claim 1, wherein said silica sol comprises 30 to 50% by weight of non-agglomerated particles of silica having an average diameter of from 9 to 100 nanometers, said non-agglomerated particles of silica being suspended within an aqueous solvent.

4. Process for fleshing skins according to claim 1, wherein 0.2 to 3% by weight of said silica sol is used relative to the weight of said skins.

5. Process for fleshing skins according to claim 1, wherein said silica sol comprises non-agglomerated particles of silica having an average diameter of from 9 to 50 nanometers.

* * * * *